US006904904B2

(12) United States Patent
Walther et al.

(10) Patent No.: US 6,904,904 B2
(45) Date of Patent: Jun. 14, 2005

(54) COOKING OVEN WITH A COOLED DOOR THAT PERMITS PYROLYSIS

(75) Inventors: Christoph Walther, Rothenburg (DE); Harald Porner, Schnaittach (DE); Vladmir Pelic, Montreal (CA); Robert McKechnie, Cabot, AR (US); Patrice Murguet, Cernay les Reims (FR); Dietmar Hildner, Furth (DE)

(73) Assignee: Electrolux Home Products Corporation N.V., Zaventem (BE)

( * ) Notice: Subject to any disclaimer, the term of this patent is extended or adjusted under 35 U.S.C. 154(b) by 0 days.

(21) Appl. No.: 10/411,574

(22) Filed: Apr. 10, 2003

(65) Prior Publication Data

US 2004/0159317 A1 Aug. 19, 2004

(30) Foreign Application Priority Data

Feb. 19, 2003 (DE) ..... 103 07 086

(51) Int. Cl.[7] ..... F24C 15/04
(52) U.S. Cl. ..... 126/198; 126/200
(58) Field of Search ..... 126/21 R, 21 A, 126/193, 198, 200

(56) References Cited

U.S. PATENT DOCUMENTS

| | | | | |
|---|---|---|---|---|
| 3,561,423 A | | 2/1971 | Holtkamp et al. | |
| 3,612,825 A | * | 10/1971 | Chase et al. | 126/200 |
| 3,717,138 A | * | 2/1973 | Upp | 126/200 |
| 3,736,916 A | | 6/1973 | White | |
| 3,760,792 A | * | 9/1973 | White | 126/198 |
| 3,818,890 A | | 6/1974 | Evans et al. | |
| 3,889,099 A | | 6/1975 | Nuss | |
| 3,889,100 A | | 6/1975 | Dills | |
| 3,893,442 A | | 7/1975 | Nuss | |
| 3,911,893 A | | 10/1975 | Baker et al. | |
| 3,962,561 A | | 6/1976 | Maitenaz | |
| 4,014,312 A | * | 3/1977 | McKelvey et al. | 126/198 |
| 4,102,322 A | | 7/1978 | Doner | |
| 4,163,444 A | | 8/1979 | Drouin | |
| 4,206,338 A | | 6/1980 | Katona | |
| 4,207,863 A | | 6/1980 | Drouin | |
| 4,253,286 A | * | 3/1981 | Katona | 126/198 |
| 4,606,324 A | | 8/1986 | Katona | |
| 4,716,884 A | | 1/1988 | Bonaccorsi et al. | |
| 5,107,821 A | | 4/1992 | von Blanquet | |
| 5,387,258 A | | 2/1995 | Puricelli | |
| 5,562,090 A | | 10/1996 | Katz | |
| 5,918,589 A | | 7/1999 | Valle et al. | |
| 5,928,540 A | | 7/1999 | Antoine et al. | |

FOREIGN PATENT DOCUMENTS

| | | | |
|---|---|---|---|
| DE | 44 07 084 A1 | | 9/1995 |
| DE | 19801585 A1 | * | 7/1999 |
| DE | 100 47 016 A1 | | 4/2002 |
| EP | 0 330 727 A1 | | 7/1988 |
| EP | 0 490 774 A1 | | 6/1992 |
| EP | 0 549 933 A1 | | 7/1993 |
| EP | 0 687 867 A1 | | 6/1995 |
| EP | 0 723 116 A2 | | 1/1996 |
| EP | 0 752 561 B1 | | 5/1996 |
| EP | 0 811 806 B1 | | 5/1997 |
| EP | 0 900 985 B1 | | 8/1998 |
| EP | 1 022 517 A1 | | 1/1999 |
| EP | 0 947 776 A2 | | 10/1999 |
| EP | 0 811 806 | | 11/2000 |
| GB | 1 344 138 | | 1/1974 |
| GB | 1 399 874 | | 7/1975 |
| GB | 2 186 967 A | | 8/1987 |
| GB | 2 257 503 A | | 7/1991 |
| GB | 2 290 335 A | | 1/1998 |

* cited by examiner

*Primary Examiner*—Sara Clarke
(74) *Attorney, Agent, or Firm*—Pearne & Gordon LLP

(57) ABSTRACT

A cooking oven includes a heatable oven chamber (6) that can be loaded with product from the outside area (A) through a loading port (8). An oven door (10) serves to close off the loading port (8) of the oven chamber (6) from the outside area (A). An inner pane (50) faces the oven chamber (6), an outer pane (48) faces the outside area (A), and one or several intermediate panes (52) are positioned between the inner pane (50) and the outer pane (48). An outer cavity (54) is between the outer pane (48) and the neighboring intermediate pane (52) and an inner cavity space (56) is between the inner pane (50) and the neighboring intermediate pane (52). A cooling system moves cooling air (K1) through the outer cavity (54) while thermally insulating air (I) can be held stationary in the inner cavity (56).

3 Claims, 11 Drawing Sheets

COOKING OVEN WITH A COOLED DOOR THAT PERMITS PYROLYSIS

FIELD OF THE INVENTION

The present invention relates to a cooking oven equipped with a heatable oven chamber loadable, with product to be cooked, from the outside through a loading port, and an oven door that serves to close off the loading port of the oven chamber from the outside. The present invention specifically relates to a cooking oven that incorporates an inner pane facing the oven chamber, an outer pane facing the outside area, and one or more intermediate panes positioned between the inner and the outer panes.

BACKGROUND OF THE INVENTION

In an earlier oven design per DE 100 47 016 A1, cooling air is drawn in between an outer pane and a neighboring intermediate pane, from there into the space or cavity between two intermediate panes and finally into the space between an intermediate pane and the inner pane, ultimately to be exhausted again. The cooling of the outer pane, however, is obtained at the expense of an effective cleaning of the inner pane by pyrolysis.

SUMMARY OF THE INVENTION

In accordance with one aspect, the present invention provides a cooking oven. A heatable oven chamber of the oven can be loaded with product from an outside area through a loading port. An oven door of the oven serves to close off the loading port of the oven chamber from the outside area. The door including an inner pane facing the oven chamber, an outer pane facing the outside area, and at least one intermediate pane positioned between the inner pane and the outer pane. An outer cavity is provided between the outer pane and the neighboring intermediate pane and an inner cavity is provided between the inner pane and the neighboring intermediate pane. The oven includes a cooling system by means of which cooling air can be moved through the outer cavity while thermally insulating air can be held stationary in the inner cavity.

In accordance with one example feature, the present invention improves pyrolytic cleaning of the inner pane while ensuring effective cooling of the outer pane. Dividing the cooling into an active ventilation of the outer cavity and a partial or complete isolation of the inner cavities ensures that, while providing good cooling of the outer pane, the inner pane that is exposed to high temperatures can contribute effectively to the pyrolysis. The stationary intermediate air engenders high temperatures as well as a homogeneous temperature distribution and correspondingly effective combustion of particles on the inner pane.

In accordance with another example feature, the present invention provides the cooling system as a system with a directional air path whereby the cooling air, primarily from the outside, is caused to enter the outer cavity from below and/or from one side or both sides and is then vented out toward the top or bottom as the case may be, and the thermally insulating air is completely enclosed or is allowed to enter the inner cavities, sealed on the top and both sides (cul-de-sac-style), from the bottom. In one particular example, the air ducting encompasses two mutually parallel longitudinal supports designed to laterally separate the inner cavity or cavities from the outer cavity. These longitudinal supports have a preferably U-shaped cross section, where the longer, outer leg of the U-profile can be attached to the inside of the outer pane especially by cementing, and the shorter inner leg of the U-profile laterally delimits the inner cavity or cavities while forming an air gap in the direction of the inside of the outer pane.

In accordance with another example feature, the present invention provides that the outer legs of the U-profile of one or both longitudinal supports are provided with air-intake openings preferably positioned in one plane with the outer cavity and/or connecting to a channel that extends in alignment with the outer cavity, counteracting (near the cemented areas) any turbulence and lowering the temperature within the longitudinal support posts, on the side panels and on the outer oven surfaces of the unit. The air current laterally entering the longitudinal supports (door posts) can be controlled and indeed naturally optimized as a function of the lateral distance between the edge of the outer pane and a side ledge or a front frame, assuring an even temperature distribution across the entire surface of the outer pane.

In accordance with another example feature, the present invention provides that the air ducting preferably also includes a transverse support which, from the top, separates the inner cavity or cavities from the outer cavity. The transverse support has a U-shaped cross section of which the outer, longer leg of the U-profile is attached to the inside of the outer pane preferably by cementing, and the inner, shorter leg of the U-profile delimits the top end of the inner cavity or cavities while forming a gap toward the inside of the outer pane.

In accordance with yet another example feature, the present invention provides that the U-shaped cross member connecting the legs of the U-profile transverse support is provided with air-exit vents preferably facing away from the outside area and pointing in the direction of the oven above the oven chamber. Here as well, to avoid turbulence and to enhance the cooling of the outer pane in the area of the door handle above the intermediate and inner panes, the transverse support is provided with a channel that is aligned with the outer cavity, connecting the latter with the air-exit vents.

In accordance with yet another example feature, the present invention provides that the transverse support is preferably mounted atop the longitudinal supports, connecting to these in a preferably detachable and, more specifically, in a slip-on fashion. In conjunction with the longitudinal supports after being detachably connected with them, it can be attached jointly with them to the outer pane, typically by cementing. This simplifies assembly and requires less cementing. The otherwise shorter leg of the U-profile is preferably extended from its two longitudinal ends to the inside of the outer pane where it, too, can be attached by cementing. For the purpose of reducing the temperature at the connecting or contact points the cemented areas may be interrupted by air gaps or applied for instance in a spot configuration.

In accordance with still another example feature, the present invention provides that the air ducting includes a connection between the bottom of the outer cavity and, where appropriate, that of the inner cavity or cavities and the outside area. In addition to the air ducting the cooling system preferably includes one or several blowers that draw the cooling air in from the outside and through the outer cavity and then exhaust the air back to the outside. The blowers are preferably located above and/or behind and/or underneath the oven chamber and connect at one end to an intake channel that leads to the air exit vents in the oven door and at the other end to an exhaust channel that leads to the outside area especially at a point above the oven door.

BRIEF DESCRIPTION OF THE DRAWINGS

The foregoing and other features and advantages of the present invention will become apparent to those skilled in the art to which the present invention relates upon reading the following description with reference to the accompanying drawings wherein.

DESCRIPTION OF AN EXAMPLE EMBODIMENT

Figure 1:
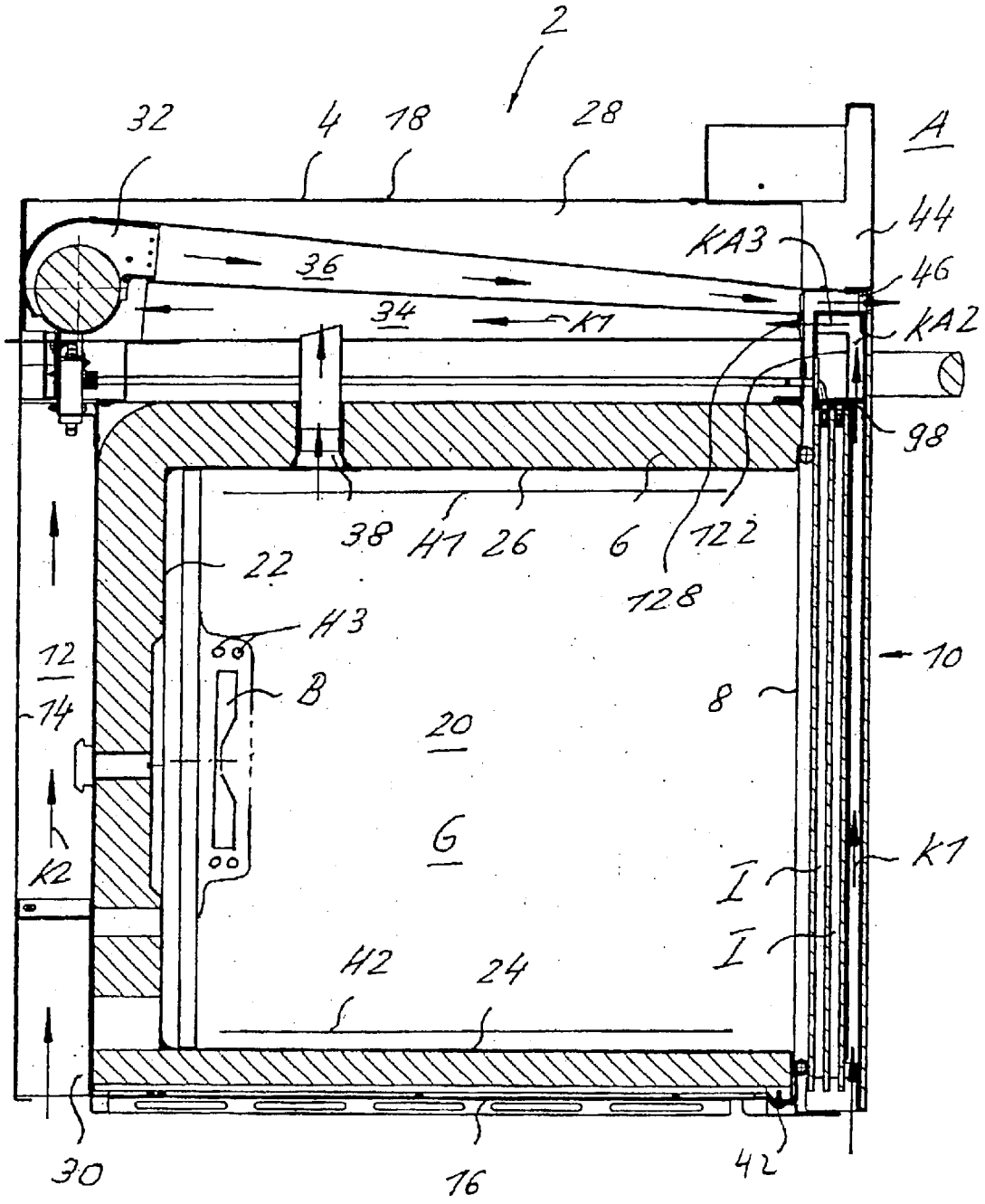
FIG. 1 is a lateral section view of an oven appliance that is one example embodiment of the present invention.

An example of an oven 2 that incorporates the present invention is shown in FIG. 1. The oven 2 includes a housing 4 that contains a heatable oven chamber 6 and a loading port 8 that can be closed by means of a door 10.

The housing 4 is a generally a cubic structure with an open front, and the oven chamber 6 has a generally cubic shape. The housing 4 has two mutually opposite side panels 12 (only one shown), a rear panel 14, a bottom panel 16 and a top panel 18. The oven chamber 6 has two mutually opposite side walls 20 (only one shown), a back wall 22, a bottom plate 24 and a top plate 26. Extending between the top panel 18 of the housing 4 and the top plate 26 of the oven chamber 6 is a horizontally extending clearance space 28. A vertical channel 30 is located between the rear panel 14 of the housing 4 and the back wall 22 of the oven chamber 6. The vertical channel 30 opens toward the bottom. A blower 32 is located in the area of the junction of the clearance space 28 and the vertical channel 30. An intake opening of the blower 32 is connected to both the vertical channel 30 and a forward-pointing horizontal intake channel 34, and an exhaust opening of the blower connects to an exhaust channel 36 above the intake channel 34. Both the intake channel 34 and the exhaust channel 36 are flared in the direction of the blower 32. A vertical vapor chimney 38 that leads into the horizontal intake channel 34 is recessed into the top plate 26 of the oven chamber 6. The oven 2 is heated by an upper heating element H1 mounted inside underneath the top panel 18, a lower heating element H2 mounted inside above the bottom panel 16, and an annular heating element H3 mounted inside in front of the back panel around a fan B.

The door 10 can be tilted around a horizontal pivot 42 in its lower section between a horizontal position in which the loading port 8 is open to admit product for cooking, and a vertical position in which the loading port is closed. An upper end of the door 10 protrudes upward past the top plate 26 of the oven chamber 6. A control panel 44 is provided above the door 10. Extending between the top end of the door 10 and the bottom end of the control panel 44 are at least in sectionally spaced fashion one or several slots or slot-shaped exhaust openings 46 that are aligned with the exhaust channel 36 and lead to the outside area A.

Figure 2:
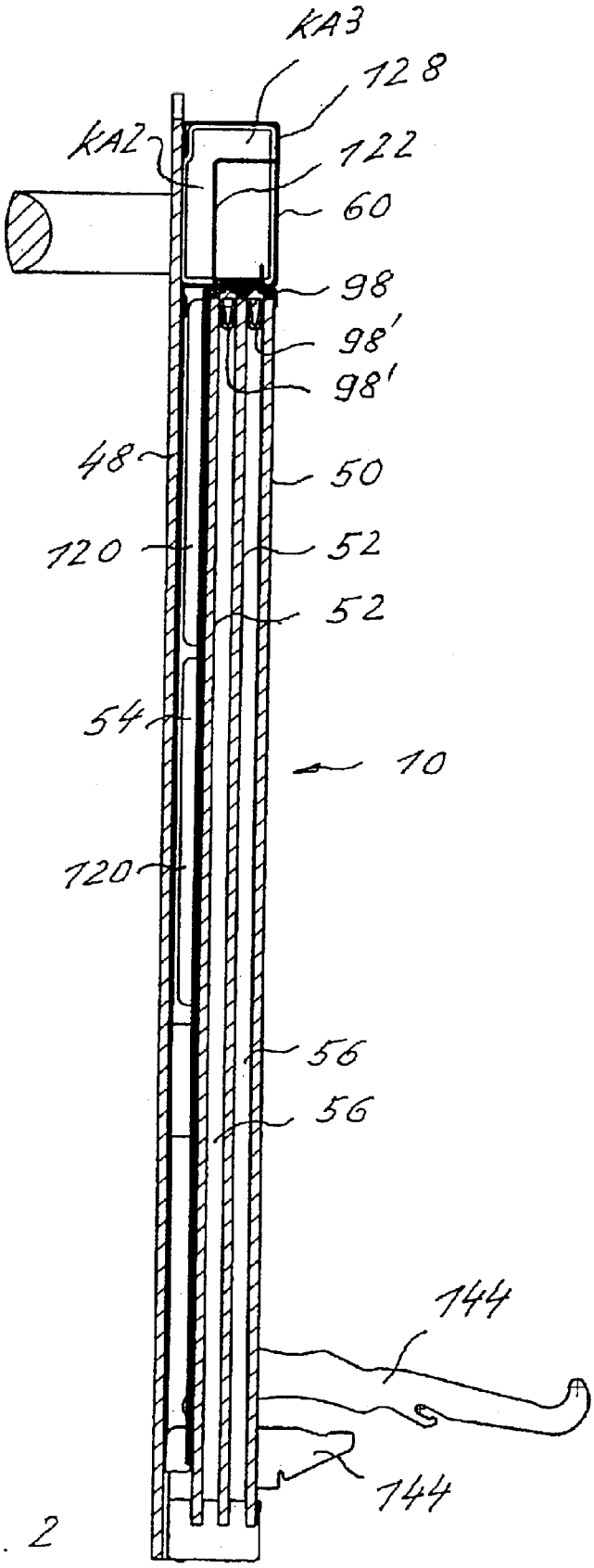
FIG. 2 is a reverse angle vertical section view of a door of the oven of FIG. 1.

The door 10 (see FIGS. 2–4, and 9) features an outer pane 48 facing the outside, an inner pane 50 facing the cooking area G (FIG. 1), and two intermediate panes 52 (FIG. 2) positioned between the outer pane 48 and the inner pane 50. All panes extend parallel to one another. The outer pane 48 is wider and taller than the other panes. As such, the outer pane 48 extends past the other panes on both sides as well as on the top and bottom. The inner pane 50 is larger than the intermediate panes 52 and extends past the intermediate panes, especially on the sides. Extending between the outer pane 48 and the neighboring intermediate pane 52 is an outer cavity 54. Inner cavities 56 are provided between the inner pane 50 and the neighboring intermediate pane 52 as well as between the two intermediate panes.

The pane configuration is basically held together by two mutually parallel support posts 58 (see FIGS. 4 and 5) that extend vertically when the door 10 is closed, and a transverse support 60 that connects the support posts 58 (refer to FIGS. 4–8). The support posts 58 and the transverse support 60 are preferably made of sheet metal. In one example, the transverse support 60 is detachably connected to the longitudinal supports 58, via interconnecting parts described below, to permit an adjustment. However, in one example, a final assembly, described below, provides for the support posts 58 and the transverse support 60 to be held in place relative to each other.

Figure 3:
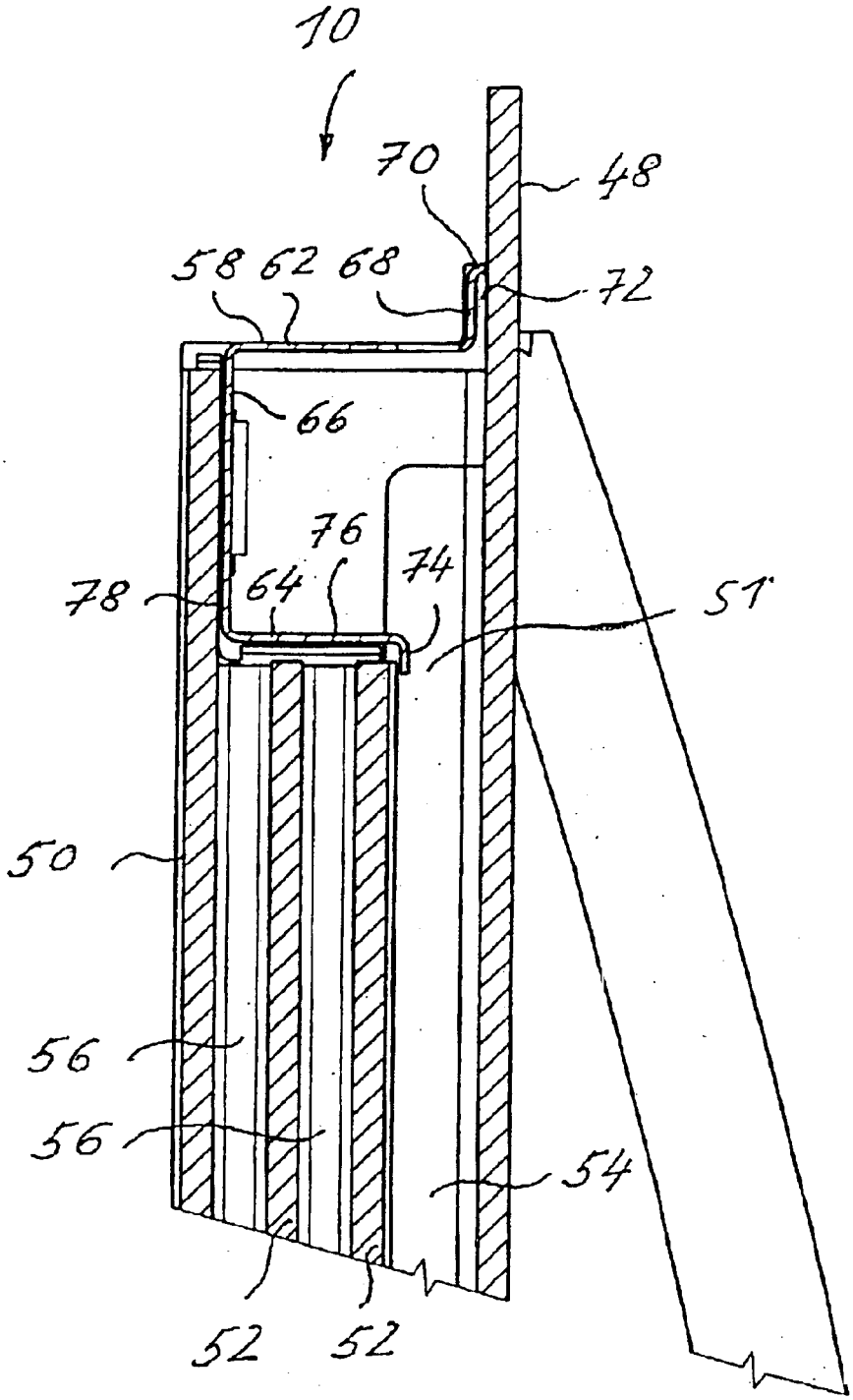
FIG. 3 is a horizontal section view of a segment of the oven door shown in FIG. 2.
Figure 7:
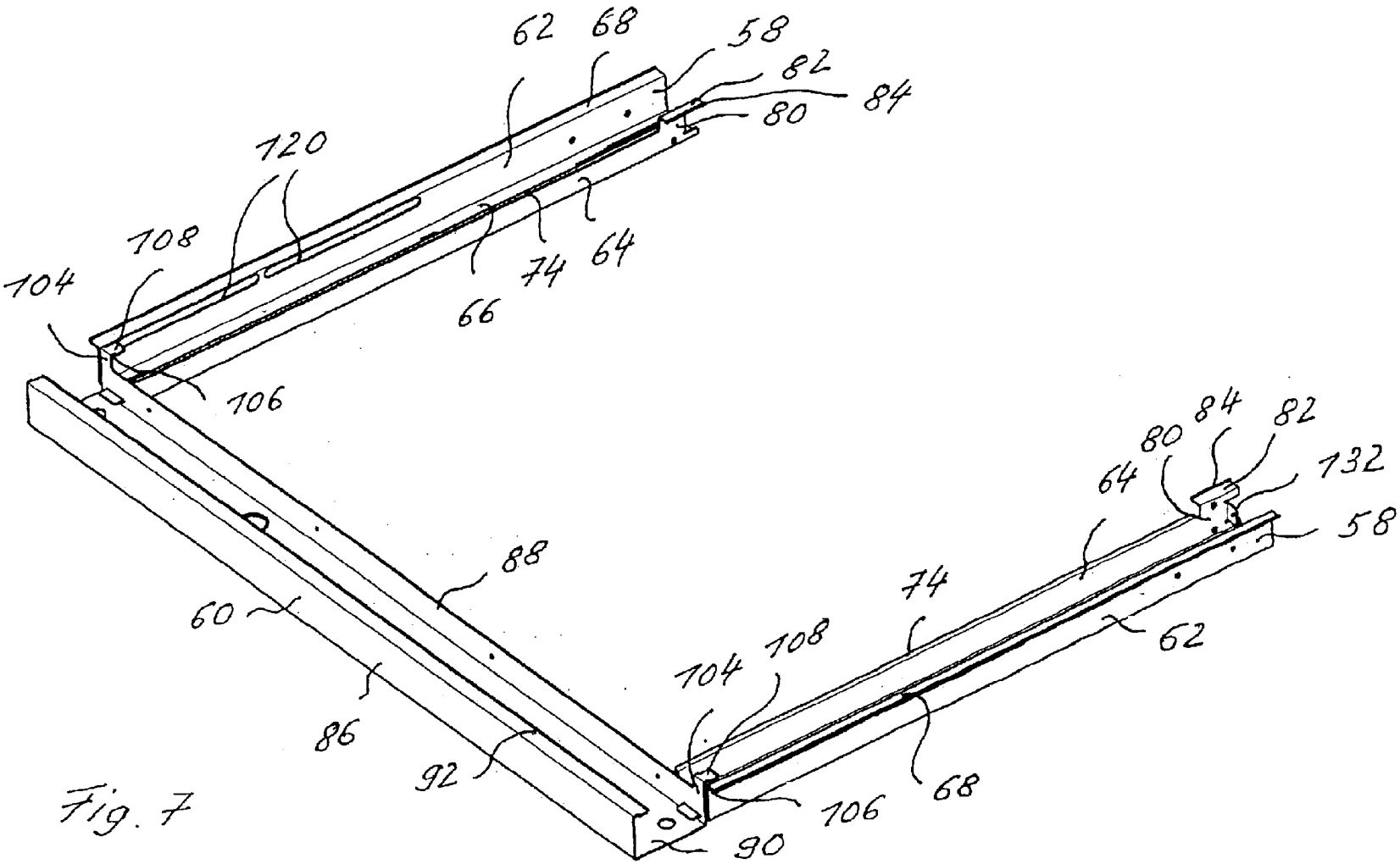
FIG. 7 is a view similar to FIG. 6, but with air ducts removed.

The support posts 58 have a U-shaped cross section (see especially FIGS. 3 and 7). The cross section includes a longer leg 62 of the U-profile, a shorter leg 64 of the U-profile and a cross member 66 connecting the two legs 62, 64 of the U-profile. At its free end, the longer leg 62 of each U-profile support post 58 includes a section 68 extending perpendicularly toward the outside and connecting to a short lip 70 that points away from the cross member 66 at a perpendicular angle. The length of the section 68 and the lip 70 is such as to accommodate an adhesive cement 72 that serves to attach the longer leg 62 of the U-profile support post 58 to the outer pane 48.

The shorter leg 64 of the U-profile support post 58 is provided at its free end with a short outward-pointing section 74 that can support one edge of the intermediate pane 52, which has a lesser longitudinal extent than the outer pane 48, neighboring the outer pane (FIG. 3). The neighboring intermediate pane 52 is located at a distance from the outer pane 48 to provide a gap S1 that provides for air communication between the outer cavity 54 and the space within the support post 58.

Figure 11:
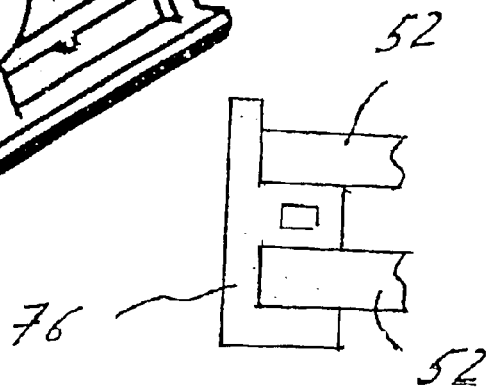
FIG. 11 is an enlarged side view of a lateral pane retainer holding panes.

The outer surface of the shorter leg 64 of the U-profile support post 58 abuts against the end faces of the two intermediate panes 52 either directly or via more or less resilient elements 76 that may be in the form of strip gaskets for laterally sealing the inner cavities 56 and/or spacers for maintaining the distance between the intermediate panes 52 and between these and, respectively, the outer and inner panes 48 and 50, for instance as continuous extrusions made from rubber or a heat-resistant plastic material with ledges engaging in the space between the intermediate panes 52. FIG. 11 illustrates one example resilient element 76 and the associated intermediate panes 52.

Abutting against the cross member 66 (FIG. 3) of the U-profile support post 58 is the inner pane 50, again either directly or via one or several resilient elements 78 in the form of sealing or attenuating elements for instance as continuous-strip seals made from rubber or a heat-resistant plastic.

At its longitudinal free ends pointing away from the transverse support 60, the otherwise shorter leg 64 of the U-profile is provided with sections 80 (see FIGS. 6 and 7) that are of the same angular length within the U-profile as the longer legs 62 of the U-profile. At that location, the otherwise shorter legs 64 feature perpendicularly outward-pointing sections or ledges 82 that connect to short sections 84, which point away from the cross member 66 at a right angle. The length of the sections 82 and 84 are such as to accommodate an adhesive cement 72 by means of which the sections 82 of the legs 64 can be attached to the inside of the outer pane 48 (recall that the outer pane 48 is removed in FIGS. 6 and 7, as such the adhesive cement 72 is also removed from the illustration).

Figure 8:
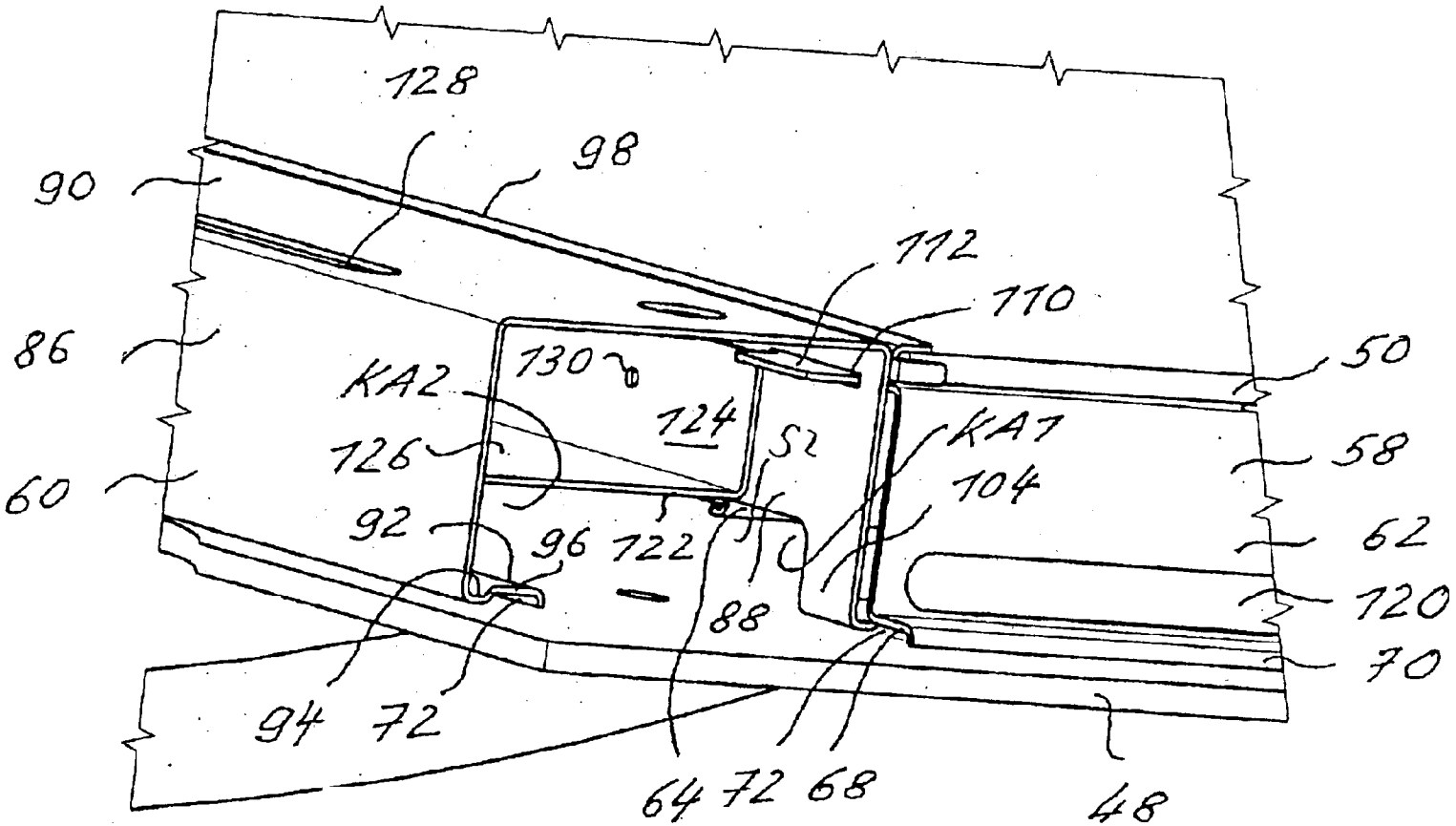
FIG. 8 is an enlarged, fragmentary perspective view showing a connection between a door post and the transverse support.

The transverse support 60 has a U-shaped profile (see FIGS. 7 and 8). That U-profile features a longer leg 86, a shorter leg 88 and a cross member 90 connecting the two legs of the U-profile. At its free end the longer leg 86 of the U-profile transverse support 60 includes a section 92 that points inward at a perpendicular angle and consists, in the order mentioned, of a slightly raised trapezoidal section 94 (see FIG. 8) that opens toward the cross member 90 as well as a slightly raised trapezoidal section 96 that opens in the direction away from the cross member, with the length and height of the sections 94 and 96 being so selected as to accommodate in the pocket-type section 96 an adhesive cement 72 by means of which the longer leg 86 of the transverse support 60 can be attached to the outer pane 48. The shorter leg 88 is dimensioned to provide a gap S2 between the outer pane and the end of the shorter leg.

The outside of the shorter leg 88 of the U-profile transverse support 60 can support one or several sheet-metal pane retainers 98 (see FIGS. 2 and 8) designed to hold the upper rims of the two intermediate panes 52 at a predefined distance from each other and from the outer pane 48 as well as from the inner pane 50. It is also possible to attach to the metal leg 88 of the U-profile transverse support 60 or to the metal pane retainers 98 mounted thereon one or several resilient (e.g., plastic) elements 98' (see FIGS. 2, 10*a*, 10*b*, and 12). The resilient elements 98' which, possibly in conjunction with the pane retainer 98, may be so configured as to serve as gaskets for the upper seal of the intermediate panes 52 and/or as soundproofing elements and/or as spacers for maintaining the distance between the intermediate panes 52 and between these and the outer and inner panes 48 and 50, respectively. Such functions for the resilient elements 98' are possible, for instance, when the elements are made (e.g., extruded) from rubber or a heat-resistant plastic material with ledges engaging between the intermediate panes 52 and, respectively, between the inner pane 50 and the neighboring intermediate pane 52.

Figure 10A:
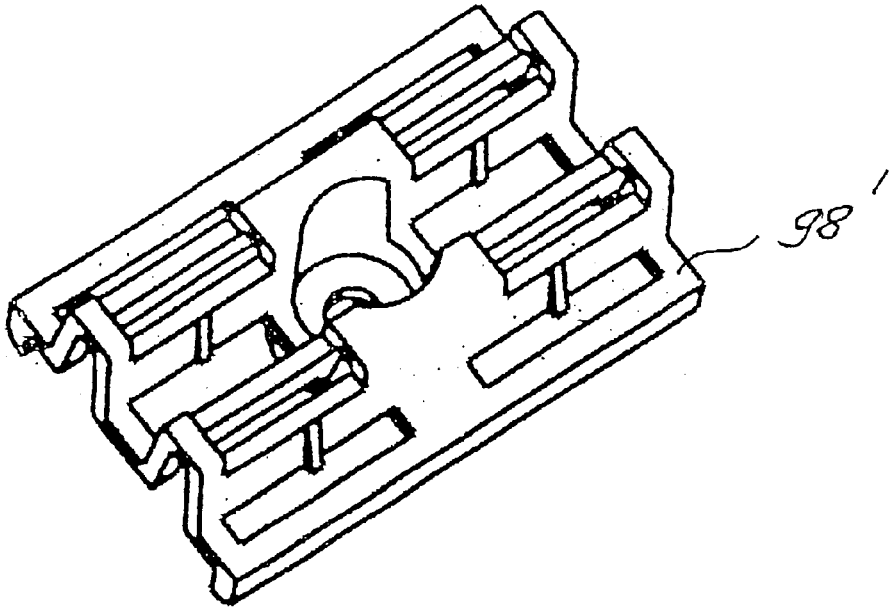
FIG. 10*a* is an enlarged perspective view of an upper pane retainer insert.
Figure 10B:
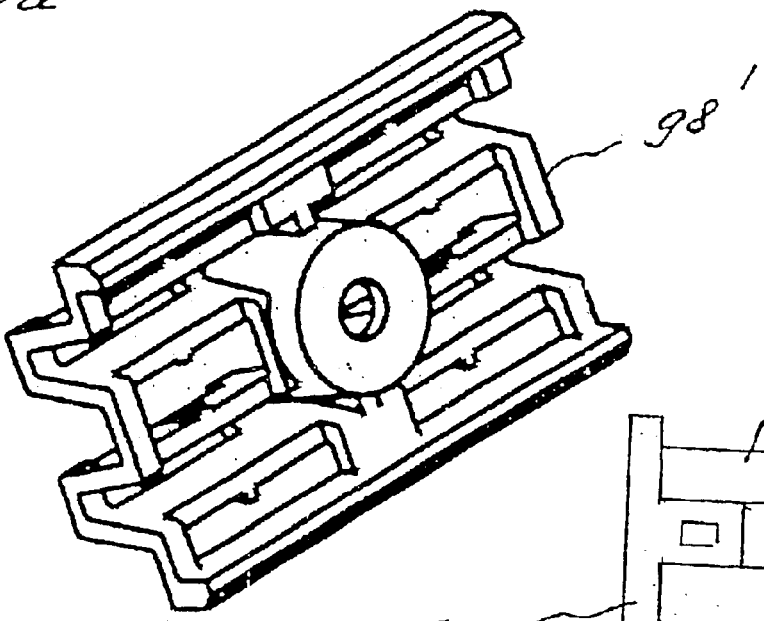
FIG. 10*b* shows the back side of the pane retainer insert of FIG. 10*a;*
Figure 12:
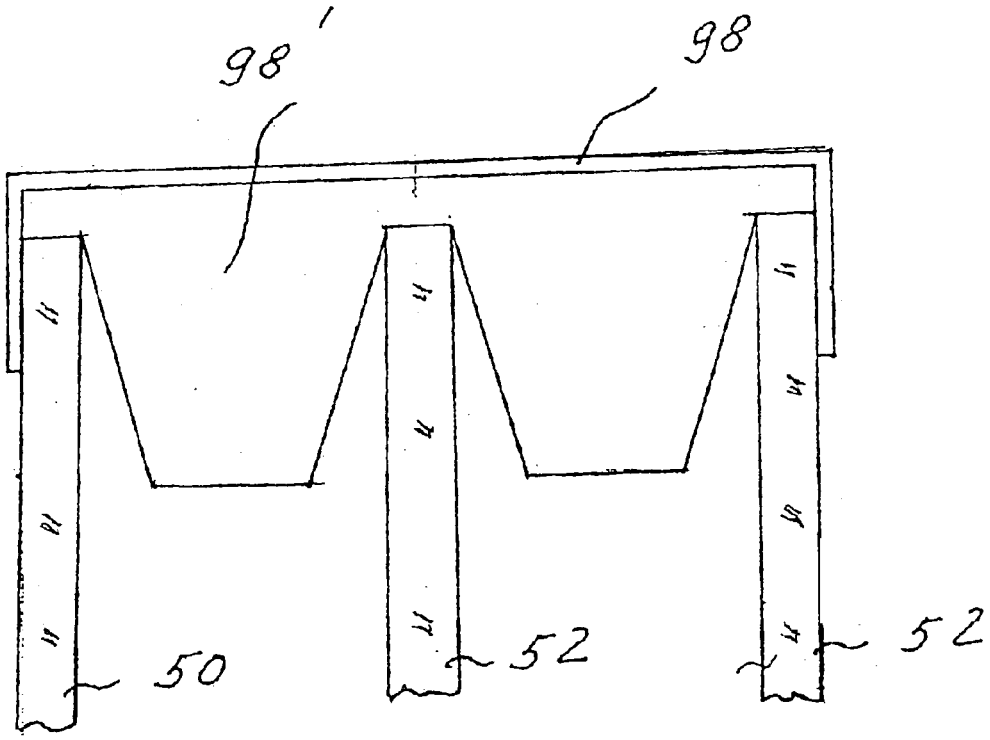
FIG. 12 is a cross section view of an upper pane retainer with a pane-retainer insert as it holds panes.

The pane retainers 98 and the resilient elements 98' may extend along the entire length of the cross member or they may be spaced apart (see FIGS. 1, 2, 5, 8, and 12). Resilient elements 98' for spaced mounting, featuring center mounting holes and two trapezoid grooved projections, are depicted in FIGS. 10*a* and 10*b*. FIG. 12 shows a resilient (spaced or continuous) element 98' fitted in a pane retainer 98 with a U-shaped cross section. An intermediate pane 52 is accommodated between two projections of the resilient element 98', another intermediate pane 52 is mounted between one of the projections and a leg of the U-shaped pane retainer 98, and the inner pane 50 is held between the other projection and the other leg of the U-shaped pane retainer.

At its two free longitudinal ends the otherwise shorter leg 88 of the U-profile transverse support 60 features sections 104 (FIG. 7) whose angular length is identical to the angular length of the longer leg 86 of the U-profile transverse support 60. The sections 104 include trapezoidal sections 106 extending parallel to the cross member 90, as well as slightly raised trapezoidal sections 108 opening in the direction away from the cross member to provide a pocket-like area. The dimensions of the sections 106 and 108 are such that the pocket-like area can accommodate an adhesive cement 72 by means of which the angularly longer sections 104 of the otherwise shorter leg 88 can be attached to the inside of the outer pane 48.

The shorter leg 88 of the U-profile transverse support 60 is provided at its two longitudinal ends near the cross member 90 with perforations especially in the form of slots 110 (FIG. 8) through which engage in form-fitted fashion sections 112 of the support posts 58 and in particular longitudinal extensions of the cross members 66 of the support posts 58 (FIG. 8). The ability to plug the support posts 58 and the transverse support 60 together makes it possible to shift the thermally conductive cementing points from the support posts 58 to the transverse support 60 and in particular to its sections 108, thus keeping them away from the area of the door handle, which keeps that region of the outer pane especially cool. The remaining area of the outer pane 48 can be kept cooler by longitudinally cementing the longer legs 62 and 86 of the support posts 58 and of the transverse support 60 to the outer pane not along a continuous strip but only along a series of spots.

Figure 6:
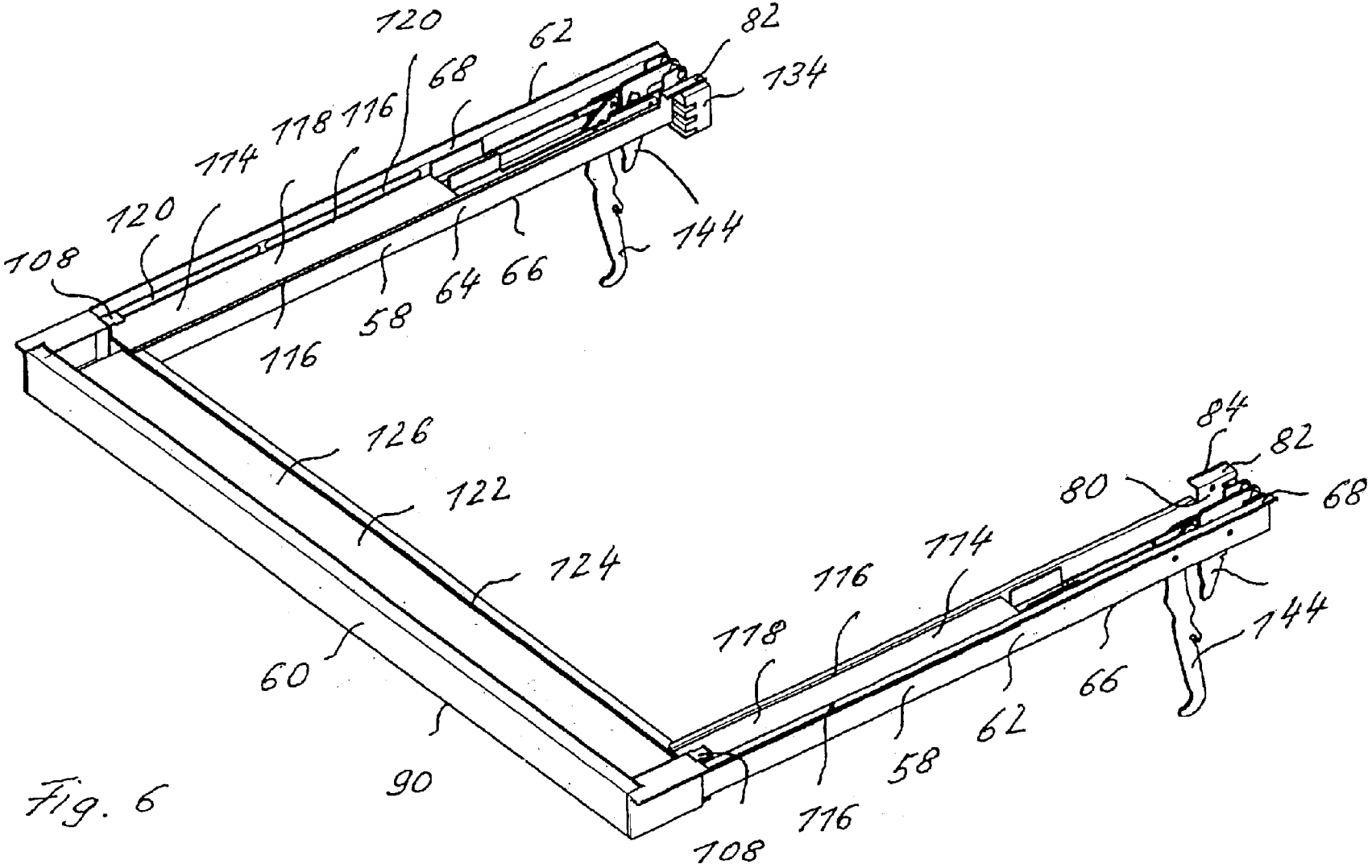
FIG. 6 is a reverse angle view of the parts shown in FIG. 5, with an outer pane also removed, but illustrating door posts connected by a transverse support.

Extending within the U-shaped cross section of the support posts 58 are U-shaped air ducts 114 (FIG. 6) whose legs 116, being of identical angular length, sit on the cross members 66 of the support posts 58. U-shaped cross members 118 connect the legs 116 of the air ducts 114 are approximately of the same inner width as the support posts 58 and essentially line up with the free edges of the shorter U-legs 64 of the support posts 58 (FIG. 6).

The legs 62 of the support posts 58 are provided with one or several air intake openings 120 (FIGS. 6-8) that extend in the longitudinal direction of the support posts 58. The openings 120 are located between the sections 68 of the legs 62 and the U-shaped cross members 118 (shown in FIG. 6) of the air ducts 114 contained in the support posts 58. When the door 10 is mounted, the air intake openings 120 line up on one side with the outer cavity 54 between the outer pane 48 and the neighboring intermediate pane 52 and on the other side with channels KA1 (FIG. 8) between the outer pane 48 and the U-profile cross members 118 of the air ducts 114 contained in the support posts 58.

The U-shaped transverse support 60 contains a U-shaped air duct 122 (FIGS. 6 and 8), the U-legs 124 of the air duct 122, being of equal angular length, sit on the cross member 90 of the transverse support 60. A cross member 126 connecting the U-legs 124 of the air duct 122 is essentially aligned with the free edge of the shorter U-leg 88 of the transverse support 60 (FIG. 8). However, between the outside surface of the leg 124 of the air duct 122 and the inside surface of the leg 86 of the transverse support 60 an air channel KA3 (FIG. 2) is formed, approximately corresponding to the space, i.e., cavity between the outer pane 48 and the neighboring intermediate pane 52 or the distance between the outer pane 48 and the U-shaped cross member 126 of the air duct 122 (channel KA2).

The U-shaped cross member 90 of the transverse support 60 is provided with one or several air exit openings 128 that extend along the transverse support 60 between its longer U-leg 86 and the nearest U-leg 124 of the air duct 122 encased in the transverse support 60 (FIG. 8).

The air ducts 114 (FIG. 6) extend along a flow channel provided by the outer cavity 54 (FIG. 2) between the outer pane 48 and the neighboring intermediate pane 52. Also, the channel provided by the outer cavity 54 extends all the way to the air intake openings 120 in the support posts 58. Further, the flow channel provided by the outer cavity 54 communicates with the air exit openings 128 in the transverse support 60. The air exit openings 128 and the air ducts 122 which extend the width of the channel formed by the outer cavity 54. Thus, an effective, turbulence-free flow of cooling air is established. Also, it should be appreciated that the air ducts 114 and 122 also absorb energy radiated by the oven chamber.

Figure 5:
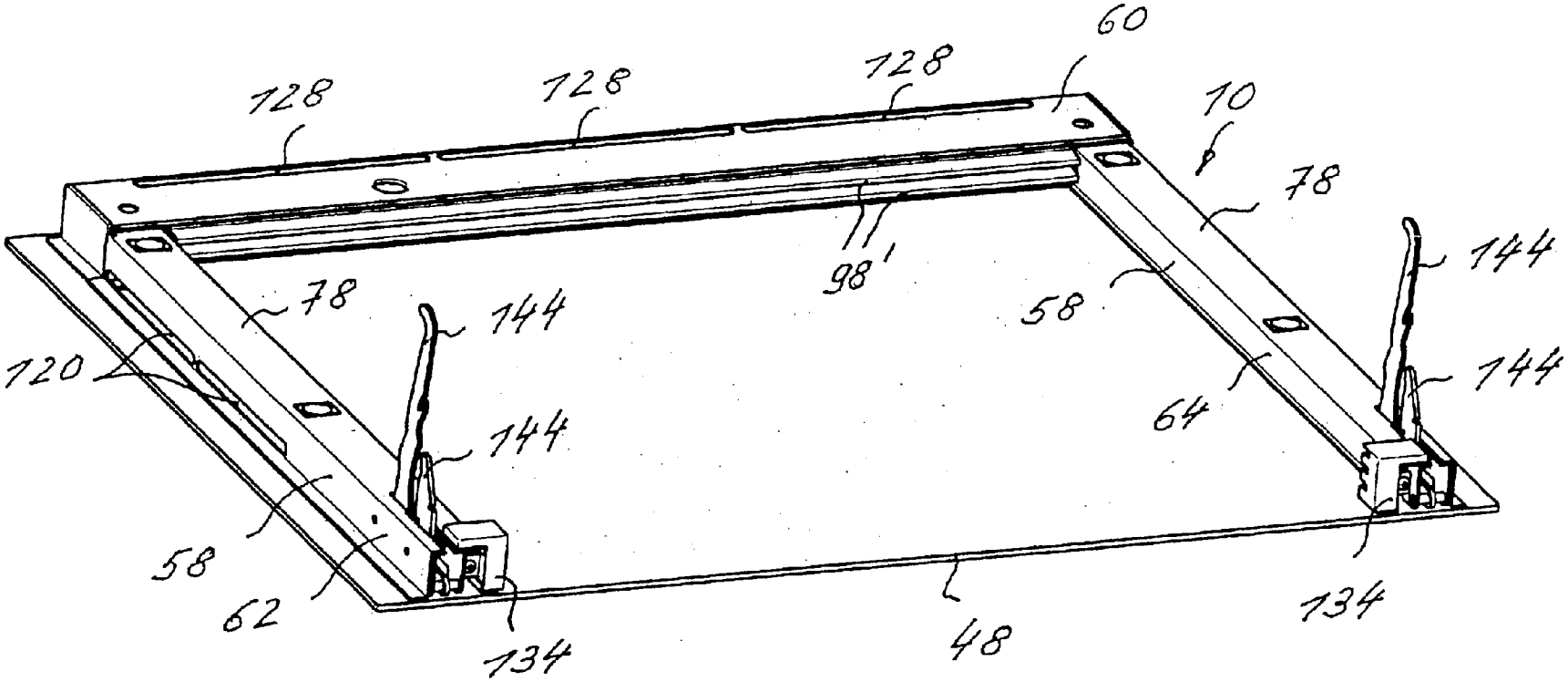
FIG. 5 shows the door of FIG. 4, but with an inner pane and intermediate panes removed.

The inner U-leg 124 of the air duct 122 is attached, via screws 130 (See FIG. 8), to the inner U-leg 88 of the transverse support 60. In addition to these screw mounts 130, the above-mentioned upper pane retainers 98 and/or resilient elements 98' are attached to the outside of the inner U-leg 88 of the transverse support 60. FIG. 5 illustrates a resilient element 98' that extends over the entire length of the transverse support 60. However, it is equally possible to substitute in its place several mutually spaced plastic elements, shown in FIGS. 10*a* and 10*b*, that feature centrally located mounting holes as well as two cross-sectionally trapezoid, grooved projections between and on which the intermediate panes 52 can be accommodated.

To support the intermediate panes 52 and the inner pane 50 (with the door closed) from below, L-shaped plastic retaining elements 134 (FIGS. 6 and 9) are mounted on horizontally extending lugs 132 in the lower sections of the support posts 58. One leg 136 of each L-shaped plastic retaining element 134 (see FIG. 9) rests on a section of the U-shaped cross member 66 of the support post 58 while the other leg 138 of the L butts laterally against the outside surface of the shorter U-leg 64. In the direction of the inner pane 50 and the two intermediate panes 52 the retaining elements 134 and in particular the legs 138 are provided with slots 140 for accepting the inner pane 50 and the intermediate panes 52 at an appropriate distance from one another.

In addition, the lower sections of the support posts 58 are equipped with hinges 142 whose lever arms 144 extend through longitudinal slots 146 in the cross members 66 of the support posts 58 and through lateral openings 148 in the inner pane 50 that is further supported by sitting over its entire width on the cross member 66.

The support posts 58, the transverse support 60, the air ducts 114 and 122 as well as the upper pane retainer 98 are made from sheet steel while the seals, attenuators and/or spacers and in particular the resilient members 74, the lower pane retainers 134, and the upper pane-retainer inserts or resilient elements 98' consist of a highly heat-resistant synthetic material such as polyamide that may be glass fiber-reinforced, or of silicone.

For a secure tilting movement, mentioned further above, the hinge lever arms 144 can be engaged and locked in openings of the oven 2 in a conventional fashion.

The door is assembled in the following manner. First, the two support posts 58 and the transverse support 60 are separately equipped with their accessories, the support posts 58 with the air ducts 114 and the hinges 142, the transverse support 60 with the air duct 122 and the upper pane retainer 98 including the resilient element(s) 98' (pane retainer inserts). After the transverse support 60 is slipped on the support posts 58 (FIG. 8, FIG. 6 without the lower pane retainer 134), these components are cemented onto the outer pane 48, preferably laid flat (FIG. 5 without the lower pane retainer 134), with the adhesive cement connections made on the outer pane 48, along the support posts 58 on the longer, outer U-legs 62, along the transverse support 60 on the longer, outer U-leg 86 and, in spot fashion, on the longitudinal free (lower) ends of the inner U-leg 64 of the support posts 58, and on the two longitudinal ends of the inner U-leg 88 of the transverse support 60. As an alternative, the bare support posts 58 may be assembled with the transverse support 60, cemented down and then jointly equipped with the accessories.

Next, resilient elements (e.g., spacers) 76 (FIG. 11), having an inverted F-profile, are pulled over mutually opposite edges of a first intermediate pane 52 in such fashion that their U-shaped lower sections hug the rims of the pane. Following that, the upper rim of the first intermediate pane 52 thus embraced is inserted in the groove nearest the outer pane 48 between the U-leg of the upper pane retainer 98 and the projection of the resilient element 98' located therein (FIG. 12, FIG. 5 minus the lower pane retainer 134) and the intermediate pane 52 is placed on the sections 74 of the shorter U-legs 64 of the support posts 58 (FIG. 3) so that it is elastically supported both in the direction of its upper and lateral end faces and in the direction of its lateral edge overlap.

Figure 4:
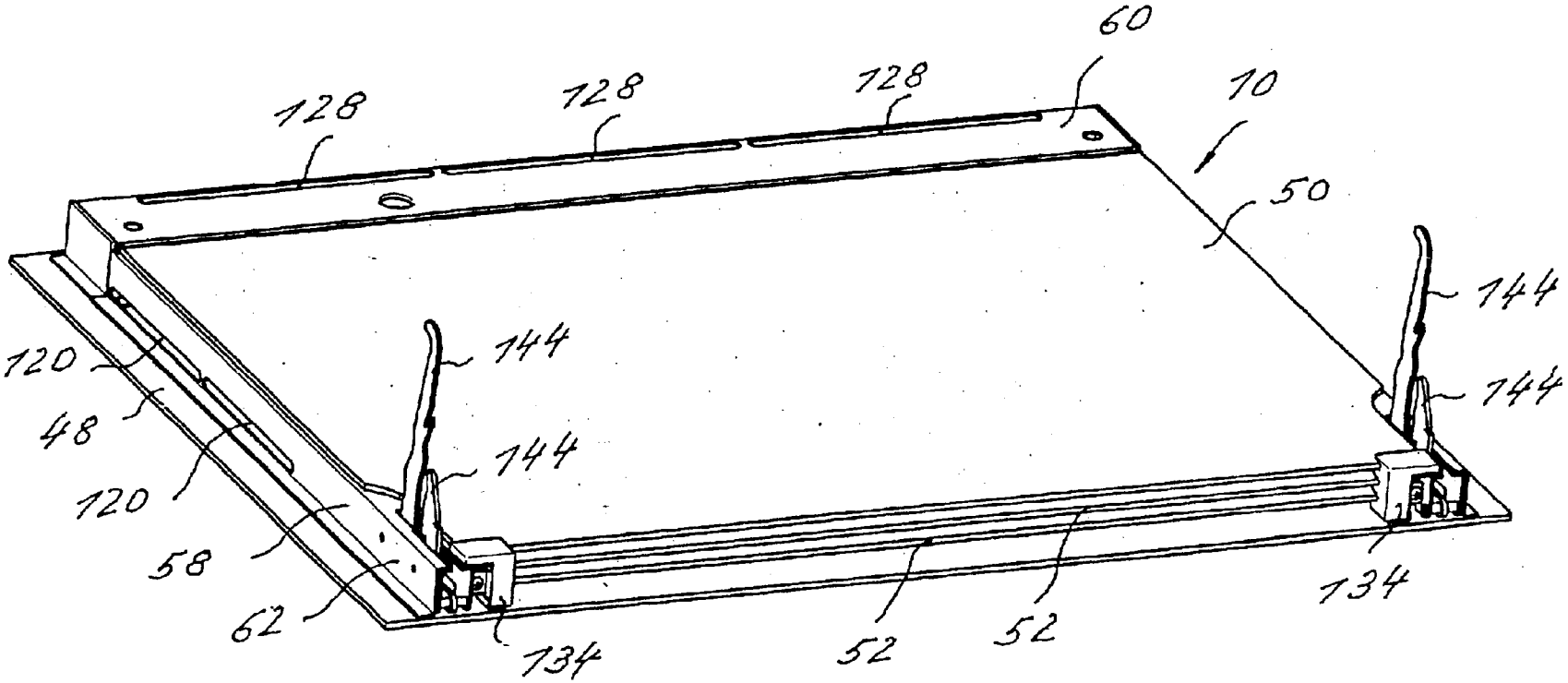
FIG. 4 is an oblique bottom view of the door of FIG. 2 lying on its outer pane.
Figure 9:
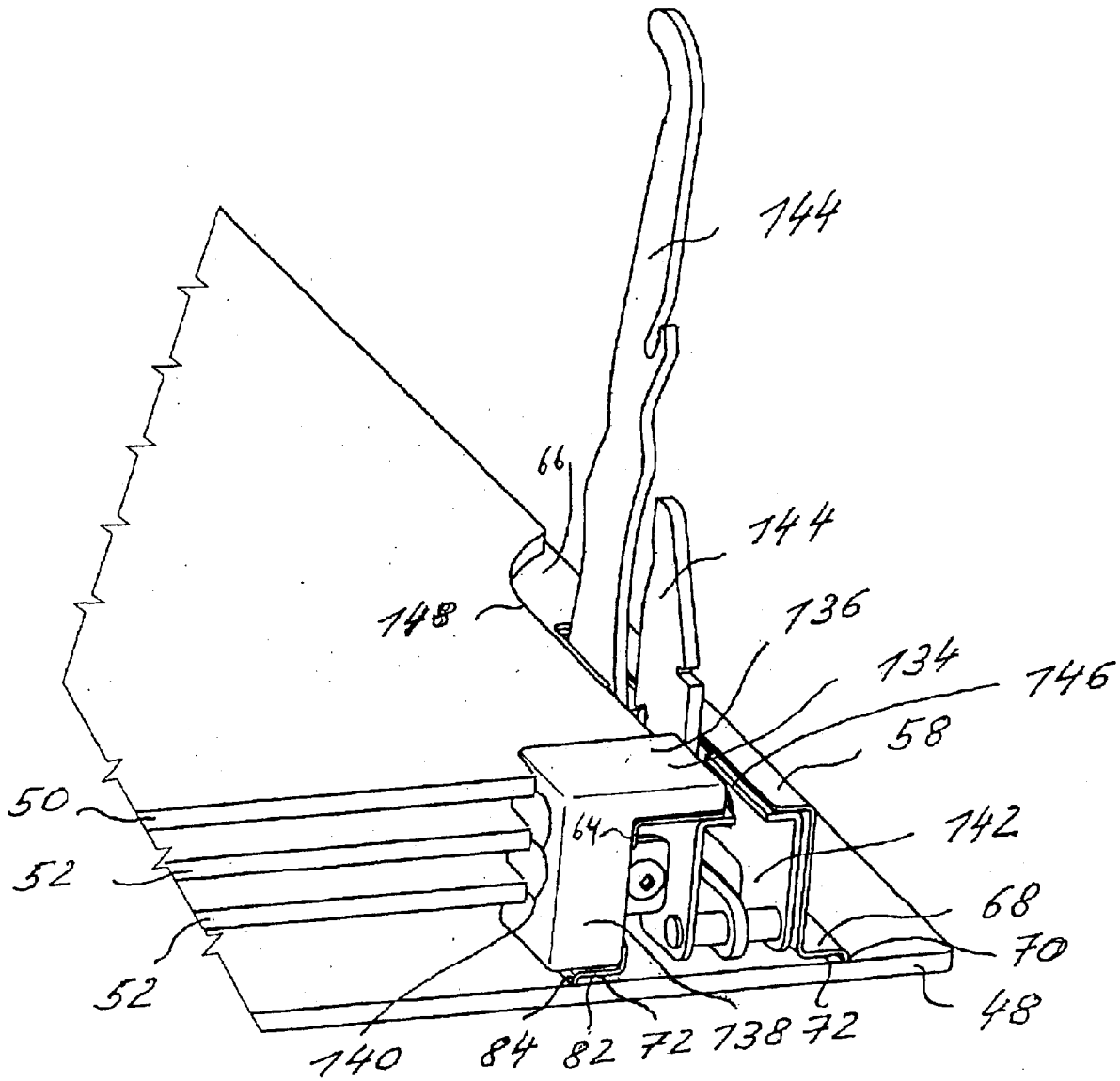
FIG. 9 is an enlarged, fragmentary perspective view of the door of FIG. 4, showing a door hinge and a pane retainer mounted on the door post.

Next, the second intermediate pane 52 is inserted in an adjacent groove between the projections of the resilient element 98' in the upper pane retainer 98 (FIG. 12, and FIG. 5 minus lower pane retainer 134) and laid down on the upward-opening sections of the resilient elements 76 (FIG. 11). Finally, the inner pane 50 is placed on the resilient elements 78 mounted on the cross members 66 of the support posts 58 and inserted in a groove between the other U-leg of the upper pane retainer 98 and a projection of the resilient element 98' positioned therein (FIG. 2, and FIGS. 4 and 9 without the lower pane retainer 134). As the final step the lower pane retainers 134 are slipped over the intermediate panes 52 and the inner pane 50 and screwed to the support posts 58 (FIGS. 4 and 9). After the door 10 is hung in the pre-installed oven 2, the oven is ready for cooking (FIG. 1).

The system works as follows. When the blower 32 is activated, air is drawn in from below through the bottom opening of the door 10 and from the sides through the air intake openings 120 in the support posts 58 and moved through the outer cavity 54 between the outer pane 48 and the neighboring intermediate pane 52, through the air exit openings 128 in the transverse support 60 and through the intake channel 34 located above the oven chamber 6, and is finally exhausted via the exhaust channel 36 above the intake channel 34 and via the slots 46 above the door 10 back to the outside (FIG. 1).

Since the inner cavities 56 between the inner pane 50 and the neighboring intermediate pane 52 and those between the two intermediate panes 52 are open on the bottom only, the air contained in these cavity spaces is unable to circulate. In this fashion, the outer pane 48 is kept cool through active cooling (forced convection) in the outer cavity 54 and by passive thermal air insulation in the cavities 56, thus protecting the operator, yet the inner pane 50 is kept hot, which promotes good pyrolytic cleaning of the inner pane through adequate decomposition of the particles adhering to the inner pane. This process is also helped by a homogeneous temperature distribution owing to the stationary air pattern in the inner cavity spaces.

Concurrently with the cooling air, the blower 32 can draw vapors from the oven 6 through the chimney 38 into the intake channel 34 and vent them via the exhaust channel 36 and the slots 46. It is equally possible to mix into the cooling air K1 drawn from the door cooling air K2 from the channel that extends behind the oven chamber, thus cooling the oven enclosure as well and/or reducing the temperature of the exhaust air.

What is claimed is:

1. A cooking oven, including:

a heatable oven chamber that can be loaded with product from an outside area through a loading port;

an oven door that serves to close off the loading port of the oven chamber from the outside area, the door including an inner pane facing the oven chamber, an outer pane facing the outside area, and at least one intermediate pane positioned between the inner pane and the outer pane, with an outer cavity provided between the outer pane and the neighboring intermediate pane and an inner cavity provided between the inner pane and the neighboring intermediate pane; and a cooling system by means of which cooling air can be moved through the outer cavity while thermally insulating air can be held stationary in the inner cavity, in which the cooling system includes air ducting that serves to guide the cooling air, primarily from an outside area that is at least at one of a location below the door and to the side of the door, into the outer cavity and through a top portion of the door to the outside area, and to entrap thermally insulating air in the inner cavity for at least one of a location at the top portion of the door and the sides of the door, and in which the air ducting includes two mutually parallel longitudinal supports which laterally separate the inner cavity from the outer cavity, and each of the longitudinal supports has a U-shaped cross section with a longer, outer leg that is attached to the outer pane and a shorter leg that laterally delimits the inner cavity and the bounds a gap with an inside surface of the outer pane.

2. An oven as set forth in claim 1, in which the outer leg of at least one of the longitudinal supports is provided with air intake openings.

3. An oven as set forth in claim 2, in which the air intake openings are located in one plane with the outer cavity and/or connect to a channel that is aligned with the outer cavity.

* * * * *